US007049273B2

(12) United States Patent
Esche, Jr. et al.

(10) Patent No.: US 7,049,273 B2
(45) Date of Patent: May 23, 2006

(54) HYBRIDIZED OLEFIN COPOLYMER ADDITIVES

(75) Inventors: Carl K. Esche, Jr., Richmond, VA (US); Charles Thomas West, Durango, CO (US)

(73) Assignee: Afton Chemical Intangibles LLC, Richmond, VA (US)

( * ) Notice: Subject to any disclaimer, the term of this patent is extended or adjusted under 35 U.S.C. 154(b) by 68 days.

(21) Appl. No.: 10/198,036

(22) Filed: Jul. 17, 2002

(65) Prior Publication Data

US 2004/0014612 A1 Jan. 22, 2004

(51) Int. Cl.
*C10M 145/18* (2006.01)
*C10M 159/16* (2006.01)
*C10L 1/22* (2006.01)

(52) U.S. Cl. ..... 508/232; 508/292; 508/452; 508/454; 44/331; 44/386; 525/298; 525/301

(58) Field of Classification Search ..... 508/454, 508/455, 452, 232; 525/298, 301; 44/331, 44/386

See application file for complete search history.

(56) References Cited

U.S. PATENT DOCUMENTS

| | | | | |
|---|---|---|---|---|
| 2,511,028 | A | | 6/1950 | Whitman |
| 2,606,924 | A | | 8/1952 | Whitman |
| 2,606,925 | A | | 8/1952 | Whitman |
| 2,606,928 | A | | 8/1952 | Barkdoll et al. |
| 3,442,808 | A | * | 5/1969 | Thornton et al. ..... 508/192 |
| 3,697,574 | A | | 10/1972 | Piasek et al. |
| 3,914,307 | A | | 10/1975 | Massie |
| 3,959,374 | A | | 5/1976 | Brennan et al. |
| 4,144,181 | A | * | 3/1979 | Elliott et al. ..... 508/241 |
| 4,293,687 | A | | 10/1981 | Weissel et al. |
| 4,340,689 | A | | 7/1982 | Joffrion |
| 4,394,523 | A | | 7/1983 | Allen |
| 4,448,995 | A | | 5/1984 | Allen |
| 4,587,329 | A | | 5/1986 | Tomalia et al. |
| 4,670,515 | A | * | 6/1987 | Olivier ..... 525/285 |
| 4,737,550 | A | | 4/1988 | Tomalia |
| 4,754,070 | A | | 6/1988 | Casey et al. |
| 4,948,842 | A | | 8/1990 | Olivier |
| 5,075,383 | A | * | 12/1991 | Migdal et al. ..... 525/293 |
| 5,219,480 | A | * | 6/1993 | Gutierrez et al. ..... 508/292 |
| 5,259,968 | A | * | 11/1993 | Emert et al. ..... 508/229 |
| 5,439,607 | A | * | 8/1995 | Patil ..... 508/239 |
| 5,578,237 | A | * | 11/1996 | Emert et al. ..... 508/454 |
| 6,107,258 | A | | 8/2000 | Esche et al. |
| 6,117,825 | A | * | 9/2000 | Liu et al. ..... 508/291 |

* cited by examiner

*Primary Examiner*—Ellen M. McAvoy
(74) *Attorney, Agent, or Firm*—Paige J. Thompson; Dennis H. Rainear

(57) ABSTRACT

This invention relates to a novel multi-functional fuel and lubricant additive that provides dispersancy properties as well as viscosity index improver credit and, improved fuel economy. The invention further relates to concentrates, and to fuel and lubricating oil compositions containing said additive or concentrates. Finally, the invention provides methods for improving fuel economy, improving dispersancy, and for preparing the hybridized, acylated olefin copolymer useful as an oil additive.

26 Claims, No Drawings

HYBRIDIZED OLEFIN COPOLYMER ADDITIVES

BACKGROUND OF THE INVENTION

This invention relates to a novel multi-functional fuel and lubricant additive that provides dispersancy properties as well as viscosity index improver credit, and fuel economy. The invention further relates to concentrates, fuel and lubricating oil compositions containing said additive.

The prior art includes an acylated olefin polymer reacted with a performance enhancing compound (commercially available from Ethyl Corporation as HiTEC® 1910 dispersant additive) and an acylated olefin polymer reacted with a performance-enhancing compound and a coupling compound. See U.S. Pat. Nos. 6,107,258 and 5,075,383, which are incorporated herein by reference in their entirety.

SUMMARY OF THE INVENTION

The present invention relates to novel hybridized olefin copolymers and their use as additives in fuel and lubricating oil compositions. The hybridized olefin copolymers of the present invention comprise an olefin copolymer on which has been grafted an ethylenically unsaturated carboxylic acid, or derivative thereof, to form an acylated olefin copolymer containing reactive carboxylic functionality. The acylated olefin copolymer is reacted with a coupling compound, which contains one or more amine, thiol and/or hydroxy functionality capable of reacting with the carboxylic functionality of preferably more than one acylated olefin copolymer to form the novel additives of the present invention.

DETAILED DESCRIPTION OF THE INVENTION

The olefin polymer or copolymer substrate employed in forming the novel additive of the present invention is derived from polymerizable $C_2$ to $C_{23}$ olefins. Such (co) polymers are typically produced from ethylene, propylene, 1-butene, 2-butene, isobutene, 1-hexene, 1-octene, 1-decene, and isomers thereof, and mixtures thereof.

Hydrogenated random and block copolymers of a vinyl aromatic compound and a conjugated diene, or mixtures of conjugated dienes, are also suitable substrates for use in the present invention. Among these types of copolymers, hydrogenated random and block copolymers of isoprene-butadiene, styrene-isoprene or styrene-butadiene are preferred.

Preferred polymers for use in the present invention are copolymers of ethylene and one or more $C_3$ to $C_{23}$ alpha-olefins. Copolymers of ethylene and propylene are most preferred. Other alpha-olefins suitable in place of propylene to form the copolymer or to be used in combination with ethylene and propylene to form a terpolymer include 1-butene, 1-pentene, 1-hexene, 1-octene, 1-decene, and styrene; also α,ω-diolefins such as 1,5-hexadiene, 1,6-heptadiene, 1,7-octadiene, etc., also branched chain alpha-olefins such as 4-methylbutene-1, 5-methylpentene-1 and 6-methylheptene-1, and mixtures thereof.

The ethylene-olefin copolymers may contain minor amounts of other olefinic monomers such as conjugated or nonconjugated dienes, and/or ethylenically unsaturated carboxylic compounds, so long as the basic characteristics (e.g., crystallinity and solubility in natural or synthetic oils) of the ethylene-olefin copolymers are not materially changed.

The polymerization reaction used to form the ethylene-olefin copolymer substrate is generally carried out in the presence of a conventional Ziegler-Natta or metallocene catalyst system. The polymerization medium is not specific and can include solution, slurry, or gas phase processes, as known to those skilled in the art. When solution polymerization is employed, the solvent may be any suitable inert hydrocarbon solvent that is liquid under reaction conditions for polymerization of alpha-olefins; examples of satisfactory hydrocarbon solvents include straight chain paraffins having from 5 to 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. When slurry polymerization is employed, the liquid phase for polymerization is preferably liquid propylene. It is desirable that the polymerization medium be free of substances that will interfere with the catalyst components.

Ethylene-propylene or higher alpha-olefin copolymers may comprise from about 15 to 80 mole percent ethylene and from about 85 to 20 mole percent propylene or a higher alpha-olefin with the preferred mole ratios being from about 25 to 75 mole percent ethylene and from about 75 to 25 mole percent of a $C_3$ to $C_{23}$ alpha-olefin. The most preferred copolymers for practice of this invention are comprised of from 30 to 70 mole percent propylene and 70 to 30 mole percent ethylene.

The number average molecular weight as determined by gel permeation chromatography, Mn, of the copolymer substrate employed in the present invention is between about 700 and about 500,000, preferably between about 3,000 and about 100,000, more preferably between about 3,000 and about 50,000. The molecular weight distribution, Mw/Mn, of the polymer substrates of the present invention is less than 15, preferably 1.0 to 10.

The terms polymer and copolymer are used generically to encompass ethylene copolymers or terpolymers.

An ethylenically unsaturated carboxylic acid material is grafted onto the prescribed polymer backbone to form an acylated ethylene copolymer. These carboxylic reactants which are suitable for grafting onto the ethylene copolymer contain at least one ethylenic bond and at least one, preferably two, carboxylic acid or its anhydride groups, or a polar group which is convertible into said carboxyl groups by oxidation or hydrolysis. Preferably, the carboxylic reactants are selected from the group consisting of acrylic, methacrylic, cinnamic, crotonic, and maleic, fumaric, and itaconic reactants of the general formula:

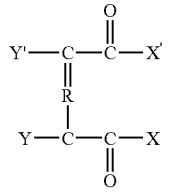

wherein R is an alkyl group having from 0–4 carbon atoms, X and X' are the same or different and are independently selected from the group consisting of —OH, —O-hydrocarbyl, —O-$M^+$ wherein $M^+$ represents one equivalent of metal, ammonium or amine cation, —$NH_2$, —Cl, —Br, and together X and X' can be —O— so as to form the anhydride, and Y and Y' are the same or different and are independently selected from the group consisting of hydrogen, branched or straight chain alkyls having 1–12 carbon atoms, a halogen atom, or an organo anhydride, ketone, or heterocyclic group having 2–12 carbon atoms. Ordinarily, the maleic or fumaric reactants will be maleic acid, fumaric acid, maleic anhydride, or a mixture of two or more of these. Maleic anhydride is generally preferred due to its commercial availability and ease of reaction.

The carboxylic reactant is grafted onto the prescribed polymer backbone in an amount of from about 0.5 to about 6 molecules of carboxylic reactant per molecule of polymer backbone based on acid number and activity of the final solution, preferably, at least 1 molecule of the carboxylic reactant per molecule of polymer backbone. More preferably, at least 1.3 molecules of the carboxylic reactant are reacted with each molecule of the polymer backbone. Throughout the specification this is referred to as the carboxylic reactant/olefin copolymer ratio.

The grafting reaction to form the acylated olefin copolymers is generally carried out with the aid of a free-radical initiator either in solution or in bulk, as in an extruder or intensive mixing device. When the polymerization is carried out in hexane solution, it is economically convenient to carry out the grafting reaction in hexane as described in U.S. Pat. Nos. 4,340,689, 4,670,515 and 4,948,842, incorporated herein by reference in their entirety. The resulting polymer intermediate is characterized by having carboxylic acid acylating functionality randomly within its structure, either along the backbone and/or at the copolymer terminus. When the site of acylation is randomly located along the copolymer backbone of the olefin copolymer and not exclusively at or near its terminus, the resulting coupled polymers of the present invention have a branched structure.

In the bulk process for forming the acylated olefin copolymers, the olefin copolymer is fed to preferably rubber or plastic processing equipment such as an extruder, intensive mixer or masticator, heated to a temperature of 150° to 400° C. and the ethylenically unsaturated carboxylic acid reagent and free-radical initiator are separately co-fed to the molten polymer to effect grafting. The reaction is carried out optionally with mixing conditions to effect shearing and grafting of the ethylene copolymers according to U.S. Pat. No. 5,075,383, incorporated herein by reference in its entirety. The processing equipment is generally purged with nitrogen to prevent oxidation of the polymer and to aid in venting unreacted reagents and byproducts of the grafting reaction. The residence time in the processing equipment is sufficient to provide for the desired degree of acylation and to allow for purification of the acylated copolymer via venting. Mineral or synthetic lubricating oil may optionally be added to the processing equipment after the venting stage to dissolve the acylated copolymer.

The free-radical initiators which may be used to graft the ethylenically unsaturated carboxylic acid material to the polymer backbone include peroxides, hydroperoxides, peresters, and also azo compounds and preferably those which have a boiling point greater than 100° C. and decompose thermally within the grafting temperature range to provide free radicals. Representatives of these free-radical initiators are azobutyronitrile, dicumyl peroxide, 2,5-dimethylhexane-2,5-bis-tertiarybutyl peroxide and 2,5-dimethyl-hex-3-yne-2,5-bis-tertiary-butyl peroxide. The initiator is used in an amount of between about 0.005% and about 1% by weight based on the weight of the reaction mixture.

Other methods known in the art for effecting reaction of olefin copolymers with ethylenic unsaturated carboxylic reagents such as halogenation reactions, thermal or "ene" reactions or mixtures thereof can be used instead of the free-radical grafting process. Such reactions are conveniently carried out in mineral oil or bulk by heating the reactants at temperatures of 250° to 400° C. under an inert atmosphere to avoid the generation of free radicals and oxidation byproducts.

For purposes of the present invention, coupling compounds are defined as those compounds containing more than one amine, thiol and/or hydroxy functional groups capable of reacting with the acylated olefin copolymer so as to link or couple one or more acylated olefin copolymers. It is preferred that the type and/or amount of coupling compound selected does not cause gelling of the polymer.

Coupling compounds for use in the present invention include organo polyamines, polyhydroxy or thiol amines, and amide-amines and wherein the organo group can be aliphatic, cycloaliphatic, aromatic, heterocyclic, or combinations thereof, and wherein the organo group is capable of undergoing a Mannich reaction yet still leave reactive nitrogens available to react with the acylated olefin copolymer. Examples of acceptable coupling compounds are described in U.S. Pat. No. 3,697,574, incorporated herein by reference in its entirety. (Although the '574 patent describes a boration step, that extra step is not necessary here). The polyisobutylene phenol can have a number average molecular weight of from about 200 to about 5000, preferably 1300 to 3000.

Another particularly suitable class of organo polyamines comprise bis(p-amino cyclohexyl) methane (PACM) and oligomers and mixtures of PACM with isomers and analogs thereof containing on average, from 2 to 6 or higher, preferably 3 to 4, cyclohexyl rings per PACM oligomer molecule. The PACM structure can be represented by the formula:

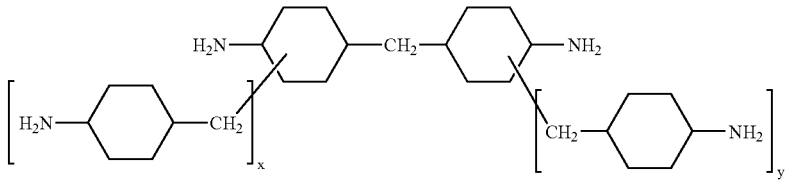

wherein x and y are the same or different and are integers of from 0 to 4, and preferably from 0 to 2, and wherein the sum of x+y is from 1 to 4, preferably 1 to 2.

The total nitrogen content of the PACM oligomers will comprise generally from 8 to 16 wt. %, and preferably from 10 to 14 wt. %.

The PACM oligomers can be obtained, e.g., by fractionation or distillation, as a heavies by-product product or bottoms from the PACM-containing product produced by high pressure catalytic hydrogenation of methylene dianiline. The hydrogenation of methylene dianiline and the separation of PACM oligomers from the resulting hydrogenation product can be accomplished by known means, including the processes disclosed in U.S. Pat. Nos. 2,511,028; 2,606,924; 2,606,925; 2,606,928; 3,914,307; 3,959,374; 4,293,687; 4, 394,523; 4,448,995 and 4,754,070, the disclosures of which are incorporated herein by reference in their entirety.

Organo polyhydroxy or thiol amines particularly useful in the practice of this invention include 2-(2-aminoethyl)aminoethanol, N-(2-hydroxypropyl) ethylene diamine, N,N-di-(2-hydroxyethyl)1,3-propylene diamine, hexamethylene diamine-2-propylene oxide (HMDA-2PO), hexamethylene diamine-3-propylene oxide (HMDA-3PO), hexamethylene diamine-4-propylene oxide (HMDA-4PO), and Mannich condensation products which are formed from a hydroxyaromatic compound (e.g., phenol, alkyl substituted phenol etc.), an aldehyde (e.g., formaldehyde, formalin, glyoxal etc.), and a polyalkenyl polyamine (e.g., pentaethylene hexamine and tetraethylene pentamine). Suitable polythiol amines include aminomercaptotriazoles.

Organo amide-amines include the linear and branched products from the reaction of alkylene diamines and alkylacrylates such as ethylene diamine and methyl acrylate or 1,4-butane diamine and methyl acrylate; such amide-amines are described in 2nd Ed. Encyclopedia of Polymer Science and Engineering, Vol. 11, Wiley-Interscience, 1988. Amido-amine dendrimers, described in U.S. Pat. Nos. 4,587,329 and 4,737,550, are prepared by alternating reactions with alkylene diamines and alkyl acrylates or acrylamides. Amido-amine dendrimers having up to 4 generations can be used to couple the acylated olefin polymers.

In preparing the coupled acylated olefin copolymers of the present invention, the molar charge of coupling compound per mole of ethylenically unsaturated carboxylic reagent (e.g. maleic anhydride) can vary depending upon the choice of coupling compound. The reaction is conveniently carried out in natural or synthetic lubricating oil under inert conditions. The ingredients are agitated at a temperature of 120° to 200° C., preferably 140° to 180° C. with a purge of inert gas to remove water and/or other low molecular weight by-products. The reaction time will vary from 30 minutes to 16 hours depending on particularly the choice of coupling compound and the specific process equipment.

The hybridized olefin copolymers of the present invention can be incorporated into a lubricating oil or a fuel in any convenient way. Thus, the hybridized olefin copolymers can be added directly to the lubricating oil or fuel by dispersing or dissolving the same in the lubricating oil or fuel at the desired level of concentration. Such blending into a finished or fully formulated lubricating oil or fuel can occur at room temperature or elevated temperatures. Alternatively, the hybridized olefin copolymers can be blended with a suitable oil-soluble solvent/diluent (such as benzene, xylene, toluene, lubricating base oils and petroleum distillates, including the various normally liquid fuels described in detail below) to form a concentrate, and then blending the concentrate with a lubricating oil or fuel to obtain the final or finished formulation. Such additive concentrates will typically contain (on an active ingredient (A.I.) basis) from about 20 to about 60 wt. % (on an active weight basis), and preferably from about 25 to about 50 wt. % (on an active weight basis), hybridized olefin copolymer additive, and typically from about 40 to 80 wt % (base oil), preferably from about 50 to 75 wt %, base oil based on the concentrate weight.

The hybridized olefin copolymer products of the present invention possess very good dispersant properties. Accordingly, the hybridized olefin copolymer products are used by incorporation and dissolution into an oleaginous material such as fuels and lubricating oils. When the products of this invention are used in normally liquid petroleum fuels such as middle distillates boiling from about 65° to 430° C., including kerosene, diesel fuels, home heating fuel oil, jet fuels, etc., a concentration of the additives in the fuel in the range of typically from about 0.001 to about 0.5, and preferably 0.005 to about 0.15 weight percent, based on the total weight of the composition, will usually by employed.

The fuel compositions of this invention can contain, in addition to the products of this invention, other additives that are well known to those of skill in the art. These can include anti-knock agents, deposit preventers or modifiers, dyes, octane improvers, cetane improvers, antioxidants, rust inhibitors, gum inhibitors, metal deactivators, and the like.

The hybridized olefin copolymer products of the present invention find their primary utility in lubricating oil compositions which employ a base oil in which the additives are dissolved or dispersed. Such base oils may be natural, synthetic or mixtures thereof. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additive mixtures of the present invention in base oils conventionally employed in and/or adapted for use as power transmitting fluids, automatic and manual transmission fluids, continuously variable transmission fluids, heavy duty hydraulic fluids, power steering fluids and the like. Gear lubricants, industrial oils, pump oils and other lubricating oil compositions can also benefit from the incorporation therein of the additive mixtures of the present invention. Surprisingly, advantageous results are even obtained when products of the present invention are incorporated in low-phosphorous lubricants having 0.1 weight percent or less and even less than 0.05 weight percent phosphorous.

A particular advantage obtained form the present invention is viscosity index improver credit imparted to a finished lubricating oil by the incorporation therein of the hybridized olefin copolymer. Typically, this VII credit can range from 5 to 50 wt. %. As more olefin copolymer of the present invention is added to or included in the dispersant or in the finished oil, increased VI credit is obtained.

These lubricating oil formulations conventionally contain additional additives that will supply the characteristics that are required in the formulations. Among these types of additives are included viscosity index improvers, antioxidants, corrosion inhibitors, detergents, dispersants, pour point depressants, antiwear agents, antifoamants, demulsifiers and friction modifiers.

In the preparation of finished lubricating oil formulations, it is common practice to introduce the additives in the form of 10 to 80 wt. % active ingredient concentrates in hydrocarbon oil, e.g. mineral or synthetic lubricating oil, or other suitable solvent. Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend. Thus, the hybridized olefin copolymer would usually be employed in the form of a 25 to 50 wt. % concentrate, used for example, at 3 to 20 wt. % in a finished oil.

The hybridized olefin copolymers of the present invention will generally be used in admixture with a lube oil basestock, comprising an oil of lubricating viscosity, including natural and synthetic lubricating oils and mixtures thereof.

Natural oils include animal oils and vegetable oils (e.g., castor, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The synthetic lubricating oils used in this invention include one of any number of commonly used synthetic hydrocarbon oils, which include, but are not limited to, poly-alpha-olefins, alkylated aromatics, alkylene oxide polymers, interpolymers, copolymers and derivatives thereof where the terminal hydroxyl groups have been modified by esterification, etherification etc, esters of dicarboxylic acids and silicon-based oils.

The hybridized olefin copolymers of the present invention may be post-treated so as to impart additional properties necessary or desired for a specific fuel or lubricant application. Post-treatment techniques are well known in the art and include boronation, phosphorylation, glycolation, carbonation with ethylene carbonate and maleination, and combinations thereof.

EXAMPLES

The experimental hybridized olefin copolymers set forth in the following examples were all prepared by the same general method. An acylated ethylene-propylene copolymer was prepared by free radically grafting maleic anhydride, in the presence of a solvent, onto an ethylene-propylene copolymer backbone. The ethylene-propylene copolymer is from about 30% to about 85% ethylene, preferably about 40% to about 60% ethylene. In the examples tested, the ethylene-propylene copolymer is about 54% ethylene. The acylated ethylene-propylene copolymer then underwent oil exchange, i.e., the solvent is removed and replaced with oil. The reaction conditions and molar proportions of maleic anhydride and ethylene-propylene copolymer were such that between about 1.3 and about 5 molecules of maleic anhydride were reacted with each molecule of the polymer backbone to form the acylated ethylene-propylene copolymer. The acylated ethylene-propylene copolymer was reacted with the coupling compound at 160° C. for approximately six hours. The molar charge of the coupling compound per mole of maleic anhydride was varied.

The polymer backbone in all of the examples is an ethylene-propylene copolymer having a number average molecular weight of approximately 10,000. The ethylene-propylene copolymers were reacted with maleic anhydride, following the above described procedures, to yield an acylated ethylene-propylene copolymer having a carboxylic reactant/olefin copolymer ratio of about 1.8. The Mannich coupling amine referred to throughout the following examples was the reaction product of a polyisobutenyl (PIB) alkylated phenol, tetraethylenepentamine (TEPA) and formaldehyde. The polyisobutene used to form the PIB alkylated phenol had an average MW of 2100.

Synthesis of Hybridized Olefin Copolymer

Into a reaction flask equipped with a condenser, water trap, stirrer, gas bubbler and thermometer is charged (600 gms, 0.553 moles nitrogen) of a Mannich coupling amine adduct of 2,100 MW PIBphenol and TEPA described above. The reagent is blanketed with nitrogen gas and heated to 100° C. Warm ethylene-propylene succinic anhydride (545.8 gms, 33.6% active, 10,000 MW E-P polymer grafted with 1.8 mols maleic anhydride per polymer chain) is slowly charged to a vigorously stirred reaction. The reaction is heated to 160° C. and stirred for 4 hours. The resultant product had the following analyticals: % N=0.688, 100° C. kinematic viscosity=547 cSt., TAN=0.5 and TBN=14.3. This product is referred to herein as Experimental Dispersant A.

Shown below in Table 1 is an experimental 5W-30 fully formulated motor oil containing 4.5 wt % experimental dispersant that is the reaction product of the acylated olefin copolymer and coupling agent (referred to as Experimental Dispersant A). The experimental oil contained a full compliment of commercially available detergents, antioxidants, friction modifiers, antiwear, antirust, antifoam, pour point, viscosity index improver and base oils typically found in a fully formulated motor oil. The comparative motor oil was identical to the experimental oil except for the dispersants as noted.

TABLE 1

Key Compositional and Analytical Data for the Experimental Dispersant A in a 5W-30 Motor Oil

| | OIL I | OIL II |
|---|---|---|
| Dispersant, wt % | | |
| Experimental Dispersant A | — | 4.5 |
| Control Dispersant (PIB-based Ethyl product) | 4.5 | — |
| VI Improver, wt. % | 9.3 | 7.2 |
| VI Improver Credit, % | — | 22 |
| EHC-45 Exxon,wt. % | 54.0 | 57.1 |
| 150 N Americas Exxon-Mobil, wt. % | 27.00 | 26.00 |
| Key Analytical Data | | |
| 100 C Vis, cSt | 10.7 | 10.6 |

As is evident from the foregoing, the experimental oil containing the dispersant additive of the present invention had a substantial viscosity index improver credit of 22%.

In another test, the ASTM Sequence VG gasoline engine test is used to evaluate the performance of gasoline engine oils in protecting engine parts from sludge and varnish. The test engine is a Ford 4.6L, spark ignition, four stroke, eight cylinder "V" configuration engine. Each test is run for 216 hours, consisting of 54 cycles or 4 hours each. Each cycle consists of 3 stages. The Sequence VG gasoline engine test results, shown below, use a 5W-30 low phosphorous (0.05 wt %) fully formulated motor oil containing 5.0 wt % of the experimental dispersant of the present invention (Oil III). The oil contained a full complement of commercially available detergents, antioxidants, friction modifiers, antiwear, antirust, antifoam, pour point, VI improver and base oils typically found in a fully formulated motor oil. The data in Table 2 illustrate the benefit of the present invention in improving the dispersancy of a lubricating oil.

TABLE 2

| VG Engine Test Results on Experimental Dispersant A In A Prototype 5W-30 Low Phosphorus Oil | | |
|---|---|---|
| | GF-3 Specs | OIL III |
| Avg. Eng. Sludge | 7.8 min | 7.85 |
| Avg. Rocker Cover Sludge | 8.0 min | 9.07 |
| Avg. Engine Varnish | 8.9 min | 9.32 |
| Avg. Piston Skirt Varnish | 7.5 min | 8.69 |
| Oil Screen Sludge, % Area | 20 max | 10 |
| Hot Stuck Rings | 0 | 0 |

In a still further test, the Sequence VIB engine test measures a lubricant's ability to improve the fuel economy of passenger car and light duty trucks. A 1993 Ford 4.6L spark ignition V-8 engine is used for the test. This test compares the performance of the test fluid to a standard fluid over five different stages of operation. Significant fuel economy was observed in the inventive oil relative to the standard fluid.

TABLE 3

| VIB Engine Test Results For Experimental Dispersant A In An Experimental 5W-30 Finished Oil | |
|---|---|
| | OIL IV |
| FEI-1, %* | 2.00 |
| FEI-2, %* | 1.22 |
| FEI-1 + FEI-2, % | 3.22 |
| Oil Consumption, ml | 1750 |

*Fuel economy improvement relative to the standard fluid

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method for preparing a hybridized, acylated olefin copolymer comprising the steps:

a) preparing an oil- or solvent-solution of an acylated olefin copolymer and having a carboxylic reactant/olefin copolymer ratio of less than two, wherein the copolymer has carboxylic acid acylating functionality randomly within the structure, b) preparing at least one coupling compound wherein the coupling compound contains one or more amino group capable of reacting with the carboxylic group of the acylated olefin copolymer, and wherein the coupling compound is a product of the reaction of a polyamine and polyisobutylene phenol, and, after preparing a) and b), c) reacting the acylated olefin copolymer with the coupling compound to effect coupling of one or more acylated olefin copolymers.

2. The method described in claim 1, wherein the olefin copolymer used in preparing the acylated and hybridized olefin copolymer has a number average molecular weight of from about 700 to about 500,000.

3. The method described in claim 1, wherein the olefin copolymer used in preparing the acylated and hybridized olefin copolymer is an ethylene-propylene copolymer.

4. The method described in claim 3, where the ethylene-propylene copolymer is from about 30% to about 85% ethylene.

5. The method described in claim 4, where the ethylene-propylene copolymer is from about 40% to about 60% ethylene.

6. The method described in claim 1, wherein the polyisobutylene phenol has a number average molecular weight of from about 200 to about 5000.

7. The method described in claim 6, wherein the polyisobutylene phenol has a number average molecular weight of from about 1300 to about 3000.

8. A hybridized, acylated olefin copolymer, comprising the reaction product of (a) an acylated olefin copolymer and having a carboxylic reactant/olefin copolymer ratio of less than two, wherein the copolymer has carboxylic acid acylating functionality randomly within the structure, and (b) a coupling compound wherein the coupling compound contains one or more amino group capable of reacting with the carboxylic group of the acylated olefin copolymer, and wherein the coupling compound is a product of the reaction of a polyamine and polyisobutylene phenol.

9. The hybridized, acylated olefin copolymer described in claim 8, wherein the olefin copolymer used in preparing the acylated and hybridized olefin copolymers has a number average molecular weight of from about 700 to about 500,000.

10. The hybridized, acylated olefin copolymer described in claim 8, wherein the olefin copolymer used in preparing the acylated and hybridized olefin copolymers is an ethylene-propylene copolymer.

11. The hybridized, acylated olefin copolymer described in claim 10, where the ethylene-propylene copolymer is from about 30% to about 85% ethylene.

12. The hybridized, acylated olefin copolymer described in claim 11, where the ethylene-propylene copolymer is from about 40% to about 60% ethylene.

13. The hybridized, acylated olefin copolymer described in claim 8, wherein the polyisobutylene phenol has a number average molecular weight of from about 200 to about 5000.

14. The hybridized, acylated olefin copolymer described in claim 13, wherein the polyisobutylene phenol has a number average molecular weight of from about 1300 to 3000.

15. An oil concentrate containing, on an active basis, 10–80 weight percent hybridized, acylated olefin copolymer of claim 8 and from 20–90 weight percent of a carrier or diluent oil.

16. An oil concentrate as described in claim 15, further comprising at least one additive selected from the group consisting of viscosity index improvers, antioxidants, corrosion inhibitors, detergents, dispersants, pour point depressants, antiwear agents, antifoamants, demulsifiers, and friction modifiers.

17. A lubricating oil composition comprising a major amount of an oil of lubricating viscosity and a minor amount of the hybridized, acylated olefin copolymer of claim 8.

18. A lubricating oil composition as described in claim 17, further comprising at least one additive selected from the group consisting of viscosity index improvers, antioxidants, corrosion inhibitors, detergents, dispersants, pour point depressants, antiwear agents, antifoamants, demulsifiers, and friction modifiers.

19. The lubricating oil composition as described in claim 17, wherein the lubricating oil composition has less than 0.1 weight percent of phosphorus.

20. The lubricating oil composition as described in claim 17, wherein the lubricating oil composition has less than 0.05 weight percent of phosphorus.

21. A method of improving the viscosity index of a lubricating oil comprising adding to an oil of lubricating viscosity a minor amount of the hybridized, acylated olefin copolymer of claim 8.

22. The copolymer of claim 8, wherein said copolymer provides viscosity index improver credit to a finished lubricant oil when said copolymer is incorporated into said oil.

23. A fuel composition comprising a major amount of a fuel and a minor amount of the hybridized acylated olefin copolymer of claim 8.

24. A method of improving the fuel economy of an engine comprising combusting in said engine a fuel composition of claim 23.

25. A method of improving the fuel economy of an engine comprising lubricating said engine with the oil of claim 21.

26. A method of improving the dispersancy of a lubricating oil by incorporating into said oil a dispersancy improving amount of the hybridized, acylated olefin copolymer of claim 8.

* * * * *